US006406252B2

(12) United States Patent
Kühn

(10) Patent No.: US 6,406,252 B2
(45) Date of Patent: Jun. 18, 2002

(54) STEAM TURBINE HAVING AN EXHAUST-STEAM CASING

(75) Inventor: Helmut Kühn, Mengelsdorf (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/829,300

(22) Filed: Apr. 9, 2001

Related U.S. Application Data

(63) Continuation of application No. PCT/DE99/03080, filed on Sep. 24, 1999.

(30) Foreign Application Priority Data

Oct. 7, 1998 (DE) ..... 198 46 224

(51) Int. Cl.[7] ..... F01D 25/26
(52) U.S. Cl. ..... 415/108; 415/211.2; 415/213.1
(58) Field of Search ..... 415/207, 211.2, 415/213.1, 214.1, 215.1, 219.1, 220, 912; 60/692

(56) References Cited

U.S. PATENT DOCUMENTS 4,130,375 A 12/1978 Korta
4,802,821 A * 2/1989 Krietmeier ..... 415/211.2
5,494,405 A 2/1996 Gray et al.
6,231,305 B1 * 5/2001 Kupka et al. ..... 415/213.1

FOREIGN PATENT DOCUMENTS

JP 61-160502 A * 7/1986 ..... 415/207

OTHER PUBLICATIONS

Published International Application No. WO 98/53183 (Kupka et al.), dated Nov. 26, 1998.
"Entwicklung einer kompakten 300–MW–Dampfturbine mit einflutigem ND–Teil und axialer Abströmung" (Tremmel et al.), dated 1992, VGB Kraftwerkstechnik, 72, pp. 33–43.

* cited by examiner

*Primary Examiner*—Christopher Verdier
(74) *Attorney, Agent, or Firm*—Laurence A. Greenberg; Werner H. Stemer; Ralph E. Locher

(57) ABSTRACT

The steam turbine has an exhaust-steam casing that can be adapted to various combinations of an inlet casing, connected upstream of the exhaust-steam casing, and a condenser especially simply while maintaining favorable flow properties of the exhaust steam. To this end, the outer jacket of the exhaust-steam casing has a first jacket part in the shape of a cylindrical jacket, which is connected via a stiffening ring to a second jacket part in the shape of a conical jacket. A guide element in the shape of a conical jacket is arranged on the stiffening ring in order to direct the exhaust-steam flow inside the outer jacket.

3 Claims, 1 Drawing Sheet

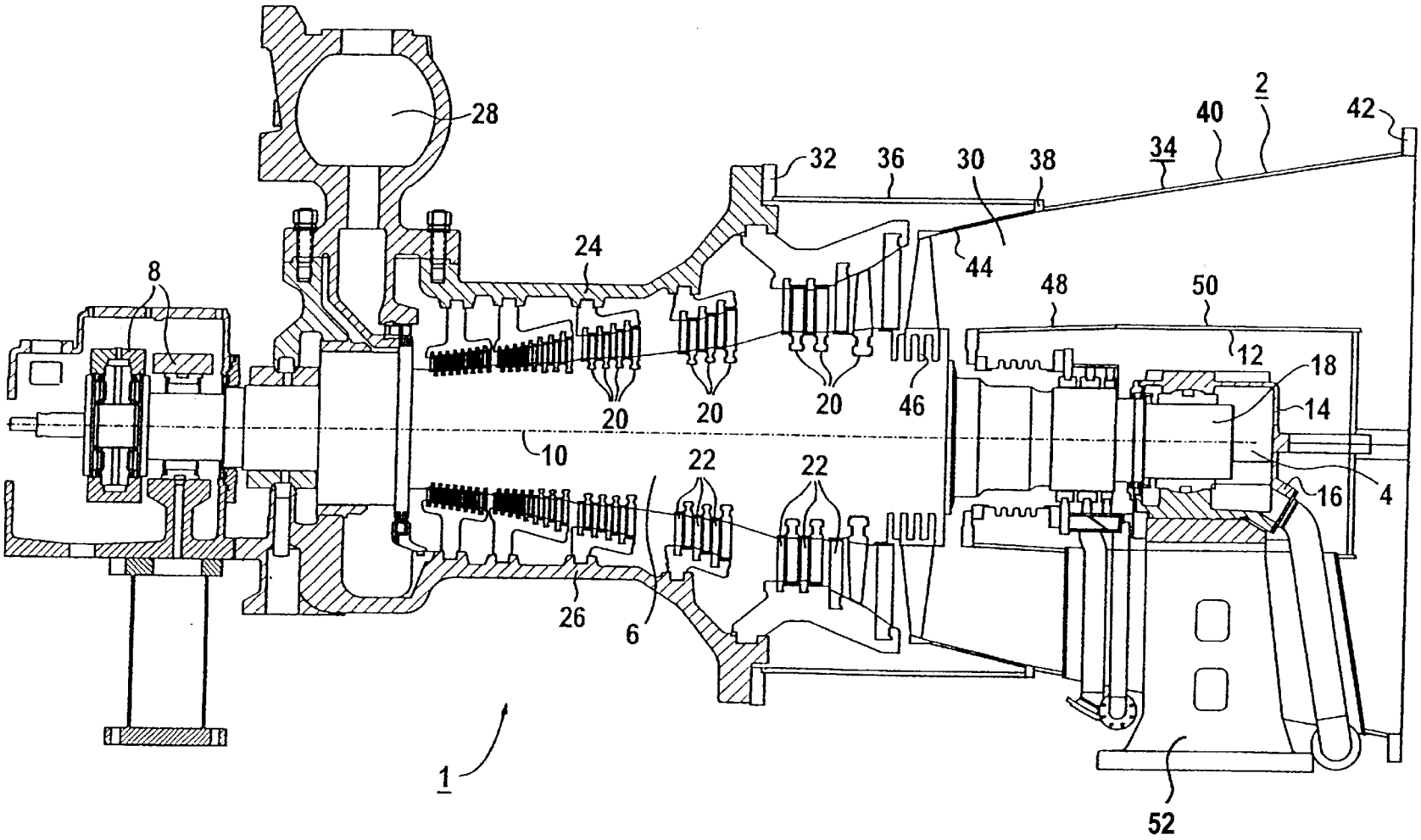
42
2
40
34
38
30
36
32
28
8
24
10
20
20
20
44
46
48
50
12
18
14
4
16
22
22
6
26
52
1

STEAM TURBINE HAVING AN EXHAUST-STEAM CASING

CROSS-REFERENCE TO RELATED APPLICATION

This application is a continuation of copending International Application No. PCT/DE99/03080, filed Sep. 24, 1999, which designated the United States.

BACKGROUND OF THE INVENTION

Field of the Invention

The invention relates to a steam turbine having an exhaust-steam casing.

A steam turbine is normally used in a power plant for driving a generator or in an industrial plant for driving a production machine. To this end, steam serving as flow medium is fed to the steam turbine and expands in the steam turbine to perform work. After its expansion, the steam normally passes via an exhaust-steam casing of the steam turbine into a condenser connected downstream of the latter and condenses there. In that case, flow may occur axially or also radially through the exhaust-steam casing. The condensate is then fed as feed water to a steam generator and passes after its evaporation into the steam turbine again, so that a closed water/steam loop is obtained.

The turbine casing of a steam turbine is normally composed of a plurality of casing sections which are adapted in their design dimensions to predetermined boundary parameters, such as, for example, the desired rating. In particular with regard to the advancing standardization and modularization in power plant construction, the casing sections can also be dimensioned for a suitable combination with other standard components.

A steam turbine with axial outflow is disclosed, for example, by Tremmel, Kachler, and Bourcier in "Entwicklung einer kompakten 300-MW-Dampfturbine mit einflutigem ND-Teil und axialer Abströmung" [Development of a compact 300 MW steam turbine with single-flow LP part and axial outflow], VGB Kraftwerkstechnik, 72, 1992, pp. 33–43. There, the exhaust steam flows through the exhaust-steam casing in a direction essentially parallel to the main axis of the turbine rotor. Such a concept may be advantageous and desirable, for example, especially for use in so-called gas-turbine and steam-turbine plants. In a steam turbine with axial outflow, the turbine rotor is normally mounted in an end bearing disposed inside the exhaust-steam casing and surrounded by an inner hub. In that case, the inner hub together with the outer jacket of the exhaust-steam casing forms a flow space of annular cross section for the exhaust steam. The flow space is normally configured as an annular diffuser virtually over the entire length of the exhaust-steam casing.

The exhaust-steam casing is normally arranged via an encircling radial flange on the casing section preceding it, which is also designated as inlet casing. With regard to its steam inflow region, the annular diffuser formed by the exhaust-steam casing is therefore largely fixed by the dimensions of the inlet casing. However, depending on the predetermined rating of the steam turbine and thus depending on the standard module selected for the inlet casing, these dimensions can vary to a comparatively large extent. On the other hand, the annular diffuser is fixed in its dimensions on the steam-outlet side by the connection diameter of the downstream condenser, which in turn, for reasons of standardization, is generally selected to be standardized irrespective of the rating of the steam turbine.

The adaptation of the exhaust-steam casing and of the annular diffuser formed at the same time to a combination of a standard module for the inlet casing with a standard module for the condenser, this combination ultimately being predetermined by the rating of the steam turbine, may therefore be comparatively complicated, especially as, on account of the functionality as a diffuser, special attention is to be paid to the configuration of the flow path. Such a complicated adaptation can largely offset the advantages which can be achieved by the modularization and/or standardization of the components.

SUMMARY OF THE INVENTION

The object of the present invention is to provide a steam turbine having an exhaust-steam casing and a turbine rotor mounted in an end bearing arranged inside the exhaust-steam casing and surrounded by an inner hub, which overcomes the above-noted deficiencies and disadvantages of the prior art devices and methods of this general kind, and in which steam turbine the exhaust-steam casing can be adapted with especially simple means to various combinations of inlet casing and condenser while maintaining favorable flow properties of the exhaust steam.

With the above and other objects in view there is provided, in accordance with the invention, a steam turbine, comprising:

a turbine rotor mounted in an end bearing;

an exhaust-steam casing enclosing the end bearing;

the exhaust-steam casing having an outer jacket formed of a first jacket part in a shape of a cylindrical jacket, a second jacket part in a shape of a conical jacket, and a stiffening ring connecting the first jacket part to the second jacket part;

a guide element in a shape of a conical jacket arranged on the stiffening ring and adapted to direct an exhaust-steam flow inside the outer jacket; and an inner hub surrounding the end bearing, the inner hub comprising a first hub part substantially in a shape of a conical jacket and a second hub part substantially in a shape of a cylindrical jacket.

In accordance with a concomitant feature of the invention, the guide element extends on an inlet side thereof beyond a last moving-blade row of the steam turbine in a direction of flow of the exhaust steam.

In other words, the objects of the invention are achieved in that outer jacket of the exhaust-steam casing comprises a first jacket part in the shape of a cylindrical jacket, which is connected via a stiffening ring to a second jacket part in the shape of a conical jacket, a guide element in the shape of a conical jacket is arranged on the stiffening ring in order to direct the exhaust-steam flow inside the outer jacket, and in that the inner hub comprises a first hub part essentially in the shape of conical jacket and a second hub part essentially in the shape of a cylindrical jacket.

The invention is based on the idea that extensive use of standard components, while ensuring high flexibility in the configuration of the flow passage, should be provided for an especially simple adaptation of the exhaust-steam casing to any desired combination of inlet casing and condenser. The standard components provided in this case are, in particular, the first jacket part in the shape of a cylindrical jacket and the second jacket part in the shape of a conical jacket. Here, the first jacket part is provided for a connection to the radial flange of the inlet casing, which radial flange may be designed in standard dimensions irrespective of the rating of the steam turbine. The second jacket part, on the other hand, is provided for the connection to the condenser and, in accordance with the normally standardized dimensioning of the latter, is likewise designed in standard dimensions. In this case, the conical-jacket-shaped design of the second jacket part assists its use in the diffuser region. At the same time, the guide element together with the second jacket part in the outer region and the inner hub in the inner region form a diffuser of annular cross section, which can be designed in a simple manner for an especially favorable flow behavior, in particular by suitable dimensioning of the first hub part in the shape of a conical jacket.

The rating-dependent adaptation is then effected in a comparatively simple manner by the guide element in the shape of a conical jacket, which is arranged inside the first jacket part and limits the inflow cross section for the steam to the selected outlet cross section of the upstream inlet casing.

The guide element expediently extends on the inlet side beyond the last moving-blade row as viewed in the direction of flow of the exhaust steam. In this way, an especially favorable fluidic transition from the inlet casing into the outflow region can be achieved, so that the diffuser function is ensured in an especially reliable manner.

The advantages achieved with the invention consist in particular in the fact that the first and second jacket parts of the outer jacket enable the exhaust-steam casing to be connected to both the upstream inlet casing and the downstream condenser in an especially simple manner via standard components, an adaptation to the inlet casing specifically selected in accordance with the required rating being ensured by the guide element. In addition, fluidically favorable shaping of the flow region is achieved by the guide element, in which case a reliably acting annular diffuser can be formed especially in combination with that part of the inner hub which is in the shape of a conical jacket, even when the flow geometry of the inlet casing varies.

Other features which are considered as characteristic for the invention are set forth in the appended claims.

Although the invention is illustrated and described herein as embodied in a steam turbine having an exhaust-steam casing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The FIGURE is a longitudinal section of a schematic diagram of a steam turbine.

DESCRIPTION OF THE PREFERRED EMBODIMENTS

Referring now to the sole FIGURE of the drawing in detail, a steam turbine 1 comprises an exhaust-steam casing 2 through which steam expanded in the steam turbine 1 can be fed in the axial outflow direction to a non-illustrated condenser that is connected downstream of the steam turbine 1. The term downstream references the flow direction of the medium through the steam turbine 1. In the exemplary embodiment, the steam turbine 1 is provided for use as an industrial turbine and is designed for a mechanical output of about 6 to 8 MW. Alternatively, however, the steam turbine 1 may also be provided for use as a power plant turbine having a comparatively higher mechanical power.

An end bearing 4 designed as a radial bearing for the turbine rotor 6 of the steam turbine 1 is arranged inside the exhaust-steam casing 2. Furthermore, the turbine rotor 6 is rotatably mounted about its center axis 10 in a number of further bearings 8 designed as radial and/or thrust bearings. The end bearing 4, which is arranged in an inner hub 12, comprises bearing parts 14, 16 which together form a bearing housing for the actual bearing 18 of the end bearing 4. Further details with regard to the configuration of the end bearing 4 and the associated sealing arrangement can likewise be seen from the FIGURE; however they are not discussed at this point for the sake of clarity.

A number of moving blades 20 combined to form blade groups are arranged on the turbine rotor 6. The moving blades 20 together with fixed guide blades or vanes 22 convert kinetic energy of the steam flowing through the steam turbine 1 into rotary energy of the turbine rotor 6.

In a forward region 24, the turbine rotor 6 is surrounded by an inlet casing 26, on which a steam-collecting space 28 in the form of a steam header is arranged for the inlet of steam into the steam turbine 1. Steam under high pressure passes via the steam-collecting space 28 into the interior of the inlet casing and thus into the region of the moving blades 20 and the guide blades 22, where it expands to perform work. On the other hand, in a rearward region 30, as viewed in the direction of flow of the steam, the turbine rotor 6 is surrounded by the exhaust-steam casing 2, which is directly connected to the inlet casing 26 via an encircling radial flange 32.

For an especially simple and cost-effective type of construction, the steam turbine is produced using a large number of standardized components. In this case, both the radial flange 32 and a connection flange of the downstream condenser are dimensioned using standard sizes. For connection to these components, the exhaust-steam casing 2 has an outer jacket 34 which has a first jacket part 36 in the shape of a cylindrical jacket. The jacket part 36, with regard to its dimensioning, in particular with regard to its diameter, is thereby adapted to the radial flange 32 and is directly connected to the latter.

On the steam-outlet side, the jacket part 36 is connected via an encircling stiffening ring 38 to a second jacket part 40 in the shape of conical jacket, which in turn is connected on the steam-outlet side via an encircling radial flange 42 directly to the connection flange of the condenser. In this case, the radial flange 42 is likewise standardized with regard to its dimensioning and is adapted to the standard sizes of the connection flange of the condenser.

The steam turbine 1 is of a modular type of construction and is adapted to a predetermined rating by selecting a suitable module for the inlet casing 26. In this case, the adaptation to the rating is effected while maintaining the standardized sizes for the radial flange 32 by suitable selection of the internal geometry, for example, of the inlet casing 26. For the specific adaptation of the exhaust-steam casing 2 to the inlet casing 26 in terms of the rating, a guide element 44 in the shape of a conical jacket for directing the exhaust-steam flow is arranged inside the outer jacket 34 on the stiffening ring 38.

The guide element 44 extends on the inlet side beyond the last row 46 (viewed in the flow direction of the exhaust steam) of the moving blades 20 and in the process forms a radial seal for the moving blades 20 of the last row 46 relative to the outer jacket 34. In this case, by suitable selection of the opening angle of the cone describing the guide element 44, an especially simple adaptation of the flow space in the exhaust-steam casing to the specific internal geometry of the inlet casing 26 is possible, even when the diameter of the stiffening ring 38 is firmly predetermined and thus standardized.

In order to form an annular diffuser, which is especially favorable for the outflow of the steam, the inner hub enclosing the end bearing 4 has a first hub part 48 essentially in the shape of a conical jacket. In addition, a second hub part So essentially in the shape of a cylindrical jacket is provided for forming the inner hub 12. The annular diffuser of the axial outflow casing 2 is therefore formed on the outside from the guide element 44 and the adjoining second jacket part 40 and on the inside from the first hub part 48 in the shape of a conical jacket and then from the second hub part 50 in the shape of a cylindrical jacket.

The end bearing 4 is retained together with the inner hub 12 by a support 52 which is passed through the exhaust-steam casing 2 in a bottom region and is supported on a non-illustrated foundation block.

I claim:

1. A steam turbine, comprising:

a turbine rotor mounted in an end bearing;

an exhaust-steam casing enclosing said end bearing;

said exhaust-steam casing having an outer jacket formed with a cylindrical jacket part, a conical jacket part, and a stiffening ring connecting said cylindrical jacket part to said conical jacket part;

a conical guide element mounted to said stiffening ring and disposed to guide an exhaust-steam flow inside said outer jacket; and an inner hub surrounding said end bearing, said inner hub having a substantially conical first hub part and a substantially cylindrical second hub part.

2. A steam turbine, comprising:

a turbine rotor mounted in an end bearing;

an exhaust-steam casing enclosing said end bearing;

said exhaust-steam casing having an outer jacket formed of a first jacket part in a shape of a cylindrical jacket, a second jacket part in a shape of a conical jacket, and a stiffening ring connecting said first jacket part to said second jacket part;

a guide element in a shape of a conical jacket arranged on said stiffening ring and adapted to direct an exhaust-steam flow inside said outer jacket; and an inner hub surrounding said end bearing, said inner hub comprising a first hub part substantially in a shape of a conical jacket and a second hub part substantially in a shape of a cylindrical jacket.

3. The steam turbine according to claim 2, wherein said guide element extends on an inlet side thereof beyond a last moving-blade row of the steam turbine in a direction of flow of the exhaust steam.

* * * * *